US009759002B2

(12) United States Patent
Muller et al.

(10) Patent No.: US 9,759,002 B2
(45) Date of Patent: Sep. 12, 2017

(54) PULL-CLOSED DEVICE FOR A MOVABLY MOUNTED FURNITURE PART

(71) Applicant: FULTERER Gesellschaft mbH, Lustenau (AT)

(72) Inventors: Wolfgang Muller, Lustenau (AT); Adis Causevic, St. Margrethen (CH); Edwin Grubel, Widnau (CH)

(73) Assignee: FULTERER Gesellschaft mbH, Lustenau (AT)

( * ) Notice: Subject to any disclaimer, the term of this patent is extended or adjusted under 35 U.S.C. 154(b) by 0 days.

(21) Appl. No.: 14/385,839

(22) PCT Filed: Feb. 8, 2013

(86) PCT No.: PCT/AT2013/000022
§ 371 (c)(1),
(2) Date: Sep. 17, 2014

(87) PCT Pub. No.: WO2013/138826
PCT Pub. Date: Sep. 26, 2013

(65) Prior Publication Data

US 2015/0047149 A1 Feb. 19, 2015

(30) Foreign Application Priority Data

Mar. 20, 2012 (AT) ..... 339/2012

(51) Int. Cl.
*A47B 88/423* (2017.01)
*E05F 3/10* (2006.01)
(Continued)

(52) U.S. Cl.
CPC ..... *E05F 3/10* (2013.01); *A47B 88/467* (2017.01); *E05F 5/10* (2013.01); *A47B 88/963* (2017.01);
(Continued)

(58) Field of Classification Search
CPC ..... E05F 5/06; E05F 5/10; E05F 5/027; E05F 5/02; E05F 5/03; E05F 3/00; E05F 3/22;
(Continued)

(56) References Cited

U.S. PATENT DOCUMENTS 2,653,043 A * 9/1953 Carlson ..... 292/78
4,426,752 A 1/1984 Nakayama
(Continued)

FOREIGN PATENT DOCUMENTS

AT 393948 1/1992
AT 401334 8/1996
(Continued)

OTHER PUBLICATIONS

Hettich translation, as provided by WIPO.*

*Primary Examiner* — Emily Morgan
(74) *Attorney, Agent, or Firm* — Volpe and Koenig, P.C.

(57) ABSTRACT

A closing device for a furniture part having a carrier connected to the movable furniture part or the body part, and a closing lever which is impinged upon by a closing spring, the closing lever having a guide track for the carrier and being pivotable by the carrier when the movable furniture part is opened between a hold-closed position and a standby position, in which the carrier uncouples from the closing lever or which is stationary with respect to the movable furniture part for the carrier connected to the body part. A closing force is exerted by the closing lever onto the carrier as of a use position assumed by the carrier in the guide track. The distance of the carrier in the use position from the lever pivoting axis of the is at least 1.5 times the distance of the carrier in the closed position from the pivoting axis.

17 Claims, 11 Drawing Sheets

(51) Int. Cl.
*E05F 5/10* (2006.01)
*A47B 88/467* (2017.01)
*A47B 88/963* (2017.01)

(52) U.S. Cl.
CPC ..... *A47B 2210/0091* (2013.01); *Y10T 16/281* (2015.01); *Y10T 16/299* (2015.01)

(58) Field of Classification Search
CPC ... E05F 3/225; E05F 3/227; E05F 3/10; E05F 3/104; E05F 5/003; A47B 88/04; A47B 88/047; A47B 88/423; A47B 88/467
See application file for complete search history.

(56) References Cited

U.S. PATENT DOCUMENTS

| | | | | |
|---|---|---|---|---|
| 4,603,239 | A | 7/1986 | Ishii | |
| 4,697,673 | A | 10/1987 | Omata | |
| 4,732,434 | A | 3/1988 | Hartrum | |
| 4,830,151 | A | 5/1989 | Numata | |
| 5,143,432 | A | 9/1992 | Ohshima et al. | |
| 5,240,318 | A | 8/1993 | Schroder et al. | |
| 5,277,282 | A | 1/1994 | Unemura | |
| 5,303,994 | A | 4/1994 | Elsholz | |
| 5,335,563 | A | 8/1994 | Yamamoto et al. | |
| 5,460,252 | A | 10/1995 | Kosugi et al. | |
| 5,887,930 | A | 3/1999 | Klein | |
| 6,095,626 | A | 8/2000 | Chen | |
| 6,312,186 | B1 | 11/2001 | Rock et al. | |
| 6,866,588 | B2 | 3/2005 | Doornbos | |
| 7,032,985 | B1 | 4/2006 | Ichioka et al. | |
| 7,815,267 | B1 | 10/2010 | Frousiakis | |
| 2002/0078529 | A1 | 6/2002 | Schwarz | |
| 2002/0101014 | A1 | 8/2002 | Kurihara et al. | |
| 2002/0157495 | A1 | 10/2002 | Goto et al. | |
| 2006/0061245 | A1 | 3/2006 | Huber et al. | |
| 2006/0113154 | A1 | 6/2006 | Hayashi et al. | |
| 2007/0145867 | A1 | 6/2007 | Gasser | |
| 2008/0290774 | A1 | 11/2008 | Gasser et al. | |
| 2009/0079312 | A1 | 3/2009 | Laible | |
| 2010/0027923 | A1 | 2/2010 | Bonat | |
| 2010/0194256 | A1 | 8/2010 | Grabherr | |
| 2010/0264794 | A1 | 10/2010 | Hu et al. | |
| 2011/0001410 | A1* | 1/2011 | Chen et al. | 312/322 |
| 2011/0001412 | A1 | 1/2011 | Zimmerman | |
| 2011/0043087 | A1* | 2/2011 | Shih et al. | 312/334.1 |
| 2011/0067964 | A1 | 3/2011 | Krammer et al. | |
| 2011/0101839 | A1 | 5/2011 | Boks | |
| 2011/0175508 | A1 | 7/2011 | Rechberg | |
| 2011/0176755 | A1* | 7/2011 | Chen et al. | 384/21 |
| 2012/0144622 | A1* | 6/2012 | Juan et al. | 16/51 |
| 2013/0133157 | A1* | 5/2013 | Kimura | 16/49 |
| 2013/0153347 | A1 | 6/2013 | Oda et al. | |
| 2015/0091427 | A1* | 4/2015 | Haemmerle et al. | 312/333 |

FOREIGN PATENT DOCUMENTS

| | | | |
|---|---|---|---|
| AT | 503877 | | 1/2008 |
| CA | 2013633 | | 10/1990 |
| CA | 2048153 | | 2/1992 |
| CN | 1367326 | | 9/2002 |
| DE | 601293 | C | 8/1934 |
| DE | 654017 | C | 12/1937 |
| DE | 2911772 | A1 | 10/1979 |
| DE | 3431386 | A1 | 3/1986 |
| DE | 9012423 | U1 | 10/1990 |
| DE | 9311534 | U1 | 12/1993 |
| DE | 4325920 | C2 | 2/1995 |
| DE | 4427026 | A1 | 8/1995 |
| DE | 29620152 | U1 | 11/1996 |
| DE | 19615433 | A1 | 1/1998 |
| DE | 19634581 | A1 | 1/1998 |
| DE | 19717937 | | 5/1998 |
| DE | 19938626 | A1 | 7/2001 |
| DE | 10214596 | | 1/2003 |
| DE | 20116197 | U1 | 2/2003 |
| DE | 10213726 | | 10/2003 |
| DE | 10210917 | | 11/2003 |
| DE | 10313659 | | 9/2004 |
| DE | 20308218 | | 9/2004 |
| DE | 20308218 | * | 10/2004 |
| DE | 202005020820 | | 9/2006 |
| DE | 102006022563 | A1 | 11/2007 |
| DE | 102006051688 | A1 | 5/2008 |
| DE | 20 2009 002 035 | U1 | 8/2010 |
| DE | 102009012921 | A1 | 9/2010 |
| DE | 102009012922 | | 9/2010 |
| DE | 102011051907 | A1 | 1/2013 |
| EP | 0593810 | | 4/1994 |
| EP | 0951848 | A1 | 10/1999 |
| EP | 1260159 | | 11/2002 |
| EP | 1336709 | A1 | 12/2002 |
| EP | 1336357 | A1 | 8/2003 |
| EP | 1384420 | | 1/2004 |
| EP | 1500763 | A2 | 1/2005 |
| EP | 1532892 | | 5/2005 |
| EP | 1561398 | A1 | 8/2005 |
| EP | 2620079 | A1 | 7/2013 |
| GB | 1117071 | | 6/1968 |
| GB | 2302906 | A1 | 2/1997 |
| GB | 2376043 | A | 12/2002 |
| JP | 59222631 | | 12/1984 |
| JP | 01266331 | A | 10/1989 |
| JP | 4321825 | | 11/1992 |
| WO | 2008107499 | A1 | 9/2008 |
| WO | 2008119091 | | 10/2008 |
| WO | 2011069175 | A1 | 6/2011 |
| WO | 2013110099 | A1 | 8/2013 |
| WO | 2013110100 | A1 | 8/2013 |
| WO | 2013110101 | A1 | 8/2013 |
| WO | 2013110102 | A1 | 9/2013 |

* cited by examiner

PULL-CLOSED DEVICE FOR A MOVABLY MOUNTED FURNITURE PART

BACKGROUND

The invention relates to a closing device for a movably mounted furniture part which, proceeding from a closed position in which a contact face of the movable furniture part abuts against a body part, is openable in an opening direction into an open position, and is closable in a closing direction, which is opposite to the opening direction, from the open position into the closed position, having a carrier which is connectable to the movable furniture part or to the body part and having a closing lever which is acted upon by a closing spring and comprises a guide track for the carrier and is pivotable by the carrier when the movable furniture part is opened between a hold-closed position, which the closing lever assumes in the closed position of the movable furniture part and in which the carrier is situated in a closed position in the guide track, and a standby position, in which the carrier uncouples from the closing lever, about a pivot axis which is stationary in relation to the body part when the carrier is connected to the movable furniture part, or in relation to the movable furniture part when the carrier is connected to the body part, wherein when the movable furniture part is closed, a closing force is exertable by the closing lever onto the carrier from a start-of-operation position assumed by the carrier in the guide track.

Different embodiments of closing devices (also called self-closing devices or pull-in mechanisms) for pull-out furniture parts, for example drawers or cupboard pull-outs, are known, which, when the pull-out furniture part is pushed in, automatically retract said pull-out furniture part over a last portion of the insert track and thus secure the completely retracted state of the pull-out furniture part. For example, AT 401334 B describes a pull-in mechanism where there is a tilt-slide device which can be displaced against the force of a spring. The tilt-slide device includes a slide which can be displaced in the pull-out direction of the drawer against the force of the spring and a tilt part which is arranged so as to be tiltable about a tilt axis. In the case of the pull-in device known from AT 393948 B there is also a tilt-slide device which can be displaced along a guide track against the force of a spring. The guide track has a straight portion and a curved portion which causes the tilt-slide device to pivot about an imaginary tilt axis into its tilted end position.

Nowadays closing devices are usually provided with slide-in dampers in order to damp the retraction movement of the pull-out furniture part in the last portion of the retraction path. Such a damped closing device where the tilt-slide device interacts with a slide-in damper is known, for example, from EP 1 532 892 A1. The spring-loaded tilt-slide device, in this case, acts with a linear damper in the form of a piston-cylinder unit which operates in particularly in a pneumatic manner. Self-closing devices which are damped by means of rotary dampers are also known.

EP 2 129 260 A1 makes known a damped closing device where a support unit which mounts the tilt-slide device is attached to a body rail of the pull-out guide of the pull-out furniture part and the carrier is incorporated into a pull-out rail of the pull-out guide which is attached to the pull-out furniture part.

In the case of pivotably mounted furniture parts, for example, cupboard doors, spring elements, which are incorporated in the hinges, automatically close the pivotable furniture part over a last portion of its closing movement and thus secure the completely closed state of the furniture part, are known. Dampers are used here too in the majority of cases to damp the closing movement.

Dampers which are realized in the form of piston-cylinder units to damp the closing of movably mounted furniture parts proceed, for example, from DE 20 2005 020 820 U1 and DE 10 213 726 A1. Rotary dampers where a highly viscous damping medium is arranged in a gap between a fixed damper part and a rotatably mounted damper part are also known. The braking force is produced from said damping medium which is stressed with shear. Dampers of this type proceed, for example, from DE 10 210 917 C1, U.S. Pat. No. 5,277,282 A, JP 59-222631 A, and U.S. Pat. No. 5,143,432 A. It is known to realize dampers for damping the closing of movably mounted furniture parts in such a manner that the damping force exerted by the damper occurs substantially only in the closing direction or is substantially greater in the closing direction than in the opening direction (such that the damper comprises a type of "free running"). DE 10 313 659 B3, DE 10 214 596 A1, DE 19 717 937 A1, AT 503 877 B1 and EP 1 260 159 A2 describe piston-cylinder units where an air pressure difference realized between the two piston ends acts on an elastically deformable piston part such that the exerted friction force depends on the air pressure difference and consequently on the speed of the component to be damped.

A damped closing device with a tilt-slide device which is mounted so as to be pivotable about a tilt axis on a slide which is mounted so as to be displaceable in a straight line proceeds from US 2011/0101839 A1. The slide is acted upon by a closing spring which cooperates with a toothed gear segment which meshes with a gear-rack-like toothing of the slide.

EP 1 384 420 B1 describes a closing lever which is realized in a bent manner, is rotatably mounted about a stationary horizontal pivot axis and is acted upon by a closing spring which is incorporated into a piston-cylinder unit which forms a damper. A carrier, which interacts with the closing lever and comprises a sliding track, is arranged on the rear side of the pull-out furniture part, for example a pantry unit pull-out. When the pull-out furniture part is pulled out, proceeding from a hold-closed position the closing lever is pivoted by the carrier about the pivot axis into a standby position in which the carrier uncouples from the closing lever. When the closing lever is pivoted from the hold-closed position into the standby position, a dead point of the closing spring is crossed such that the closing lever is held by the closing spring in the standby position. When the pull-out furniture part is pushed in, a projection of the closing lever moves into the sliding track of the carrier, the closing lever coupling with the carrier and being pivoted over the dead point of the closing spring. As a result, the closing lever pulls the pull-out furniture part into its completely retracted position. The closing spring is tensioned the strongest in the dead point position of the closing lever in which the closing spring is situated at its dead point. When the pull-out furniture part is pulled out, the closing force exerted onto the pull-out furniture part by the closing lever and acting in the closing direction increases, proceeding from the closed position of the pull-out furniture part, until the closing lever reaches its dead point position.

A closing device of the type mentioned in the introduction proceeds from GB 1,117,071. A spring-loaded closing lever which is mounted so as to be pivotable about an axis which is stationary in relation to the furniture body, and is pivoted by a carrier, which is mounted on the pull-out furniture part, between a hold-closed position, which the closing lever assumes in the closed state of the pull-out furniture part, and a standby position. The spring, in this connection, is moved over a dead point. Here too, the force to be overcome when the pull-out furniture part is pulled out until the dead point of the spring is reached is relatively high compared to the closing force exerted onto the pull-out furniture part in the closing position.

SUMMARY

It is the object of the invention to provide a closing device of the type mentioned in the introduction where, in the closed position of the furniture part, a relative high closing force is able to be exerted onto the movable furniture part, with which said movable furniture part is pressed in the closing direction against the body part, relatively easy opening of the moveable furniture part nevertheless having to be possible. This is achieved as a result of a closing device with one or more features of the invention.

In the case of the closing device according to the invention, a distance between the carrier in its start-of-operation position, from which when the movable furniture part is closed a closing force is exertable by the closing lever onto the carrier, and the pivot axis of the closing lever is at least 1.5 times, preferably at least 2 times as great as the distance between the carrier in its closed position and the pivot axis of the closing lever.

As a result, it is possible to bring about a relatively large closing force which acts in the closing direction and is exerted on the movable furniture part which is situated in the closed position, the force which is required for pivoting the closing lever from its hold-closed position as far as into its standby position, being able to be kept relatively small.

In particular, as a result, in the closed position of the movable furniture part a pressing force can be brought about which is sufficient for a seal which is arranged between the body part and the movable furniture part. As a result, reliable sealing can be achieved. For example, this can be a question of a refrigeration appliance or another item of furniture which has a different climate compared to the atmosphere, e.g. a different temperature, in the interior. The seal can be mounted on the body part or on the movable furniture part.

The closing force exerted on the carrier by the closing lever acts on the carrier by means of a closing lever arm. The closing lever arm, with the carrier in the start-of-operation position, is preferably at least 1.5 times as long, in a particularly preferred manner at least twice as long as in the closed position of the carrier. In a favorable manner, the closing lever arm, in this connection, reduces continually from the start-of-operation position of the carrier up to the closed position of the carrier or reduces continually up to a minimum which is present at an intermediate position of the closing lever and after running through the minimum increases again by a maximum of 30%, preferably by a maximum of 15%, in relation to the value present at the minimum. In the latter case, the closing lever, in the intermediate position in which the closing lever is at its minimum size, has already run through at least two thirds of its overall pivot angle between the standby position and the hold-closed position.

In order to achieve a high closing force acting in the closing direction onto the furniture part situated in the closed position, it is preferred that the angle between the closing force exerted by the closing lever onto the carrier and the closing direction in the hold-closed position of the closing lever is less than 45°, in a particularly preferred manner less than 40°.

In an advantageous embodiment of the invention, the guide track of the closing lever has a curved development, by means of which the closing force exerted onto the movable furniture part is able to be influenced. If we look at the position of the closing lever which said closing lever assumes when the carrier is in its start-of-operation position, the guide track, in this connection, has a first part portion which proceeds from the start of the guide track, at which the carrier runs into the guide track when the moveable furniture part is closed, and a second part portion which adjoins to the first part portion. The guide track extends over the first part portion in a direction which, with the closing direction of the movable furniture part, encloses an angle which is greater than the angle which a direction, which points from the center of the carrier situated in the start-of-operation position to the pivot axis of the closing lever, encloses with the closing direction. The second part portion extends in a direction which encloses with the closing direction an angle which is smaller than the angle which the direction, which in the start-of-operation position of the carrier points from the center of the carrier to the pivot axis of the closing lever, encloses with the closing direction. As a result of this realization, the closing force, which is exerted by the closing lever onto the movable furniture part and acts in the closing direction, is able to be increased over a first phase of the pulling-closed of the movable furniture part by the closing lever compared to the closing force occurring in the case of a straight line development of the guide track and can be lowered in a second phase of the retracting, it nevertheless being possible to achieve a high closing force in the closed position of the movable furniture part.

In an advantageous manner, the residual tension which the closing spring comprises in the closed position of the carrier compared to the non-tensioned state of the closing spring, is greater than the difference between the tension of the closing spring which said closing spring has in the start-of-operation position of the carrier, and the tension of the closing spring which said closing spring comprises in the closed position of the carrier. In the event of the realization of the closing spring in the form of a helical spring, this is achieved in that the difference between the length of the closing spring in the closed position of the carrier and the length of the closing spring in its non-tensioned state is greater than the difference between the length of the closing spring which said closing spring comprises in the start-of-operation position of the carrier, and the length of the closing spring which said closing spring comprises in the closed position of the carrier. This is achieved by a sufficiently long closing spring.

Since as a result of such a realization of the closing spring, the utilized characteristic region is relatively flat, this also contributes to the fact that a relatively high closing force is achieved in the closed state of the movable furniture part and it is nevertheless relatively easy to open the movable furniture part.

In a preferred embodiment of the invention, the pivoting of the closing lever from the standby position into the hold-closed position is damped by at least one damper, in particular a linear damper. The at least one damper is favorably connected at one end to a push rod which is pivotably connected to the closing lever, at the other end to the support unit. In order to achieve as linear a displacement as possible of the end of the push rod to which the at least one damper is connected, the push rod is advantageously guided by a curved sliding track. In addition, in a favorable manner there is a linear guide for the push rod which is situated closer to the end of the push rod connected to the at least one damper than the sliding guide.

In order to absorb forces or force components exerted onto the carrier which act at right angles to the opening or closing direction, the support unit on which the closing lever is pivotably mounted preferably comprises a lateral guide for the carrier which extends in the closing direction.

BRIEF DESCRIPTION OF THE DRAWINGS

Further advantages and details of the invention are explained below by way of the accompanying drawing, in which.

DETAILED DESCRIPTION OF THE PREFERRED EMBODIMENTS

A first exemplary embodiment of the invention is shown in FIGS. 1 to 17.

A respective closing device includes a closing unit 1, which is fastened on a body part 2 of the item of furniture, and a carrier unit 3 which is fastened on the respective movable furniture part 4.

Figure 1:
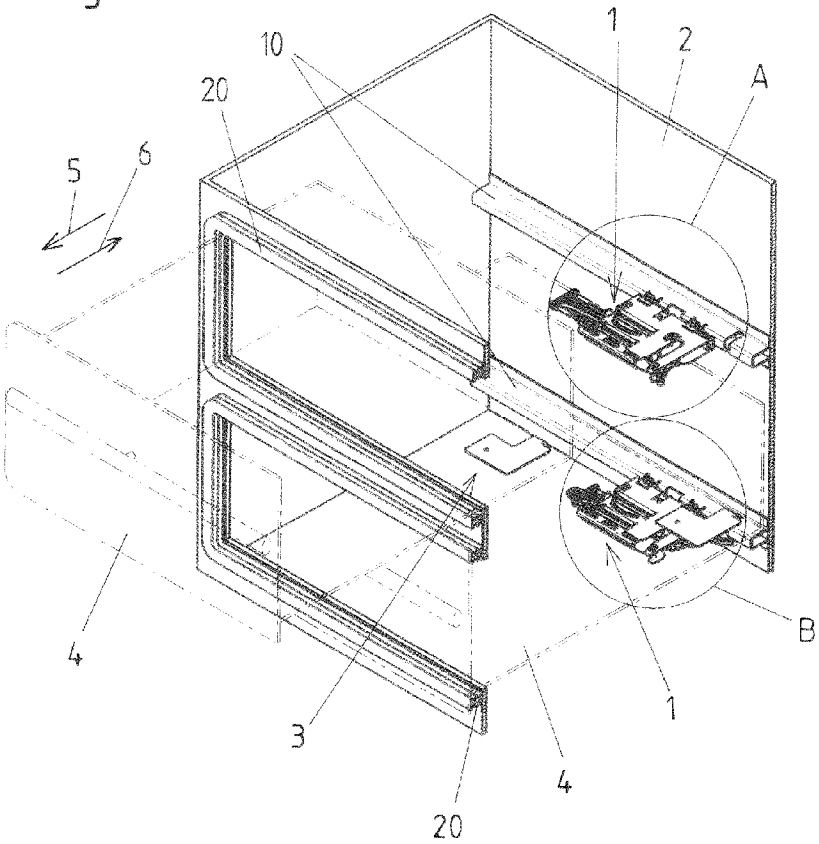
FIG. 1 shows a perspective view of an item of furniture which is provided with retraction devices according to the invention, the furniture body only being shown in part and the movable furniture parts being indicated by dot-dash lines.
Figure 4:
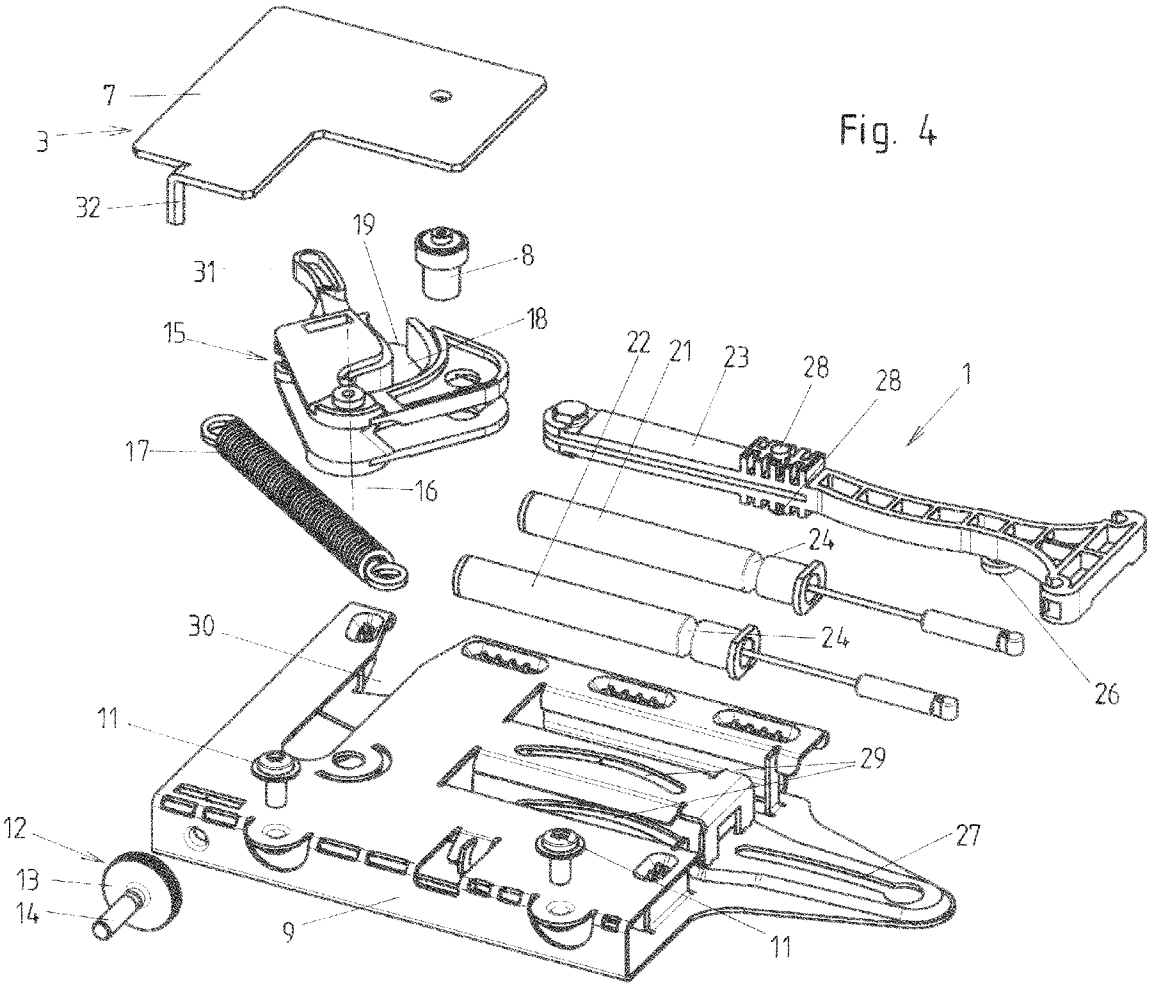
FIG. 4 shows an exploded representation of the closing device.

In the exemplary embodiment the movable furniture parts 4 are displaceable in a straight line from a closed position (in which the bottom movable furniture part 4 shown in FIG. 1 is situated) in an opening direction 5 up to into an open position (in which the top movable furniture part shown in FIG. 1 is situated) and are displaceable in the closing direction 6, which is opposite to the opening direction, from the open position into the closed position. These are therefore pull-out and retractable furniture parts 4 which, for example, can be realized in the form of drawers, pull-out shelves or cupboard pull-outs. Pull-out guides which are not shown here serve for pulling out and retracting the furniture parts 4.

The carrier unit 3 includes a support plate 7 which is fastened on the furniture part 4, for example by means of spot welding, and a carrier 8 which stands out from the support plate 7. A flap is punched out of the support plate and bent around realizing a self-heal journal 32, the function of which is explained in more detail below. The carrier 8 can be formed from a rigid journal or can comprise a roller which interacts with the guide track 18 described below.

The closing unit 1 includes a support unit 9 which is rigidly connected to the body part 2 and, for example as shown, is form by a curved plate. The support unit 9, in the exemplary embodiment, is mounted with the body part 2 by means of a mounting rail 10 which is fastened on the body part 2, for example by means of screw connection. Fastening screws 11 which penetrate elongated holes in the mounting rail 10 and an adjusting screw 12 serve for fastening on the mounting rail 10. A head 13 of the adjusting screw 12 penetrates slots in oppositely located lateral portions of the support unit 9 and as a result is held so as to be rotatable, but axially non-displaceable in the support unit 9. The shaft 14 of the adjusting screw is screwed into a thread of the mounting rail 10.

A closing lever 15 is mounted on the support unit 9 so as to be pivotable about a pivot axis 16, the pivot axis 16 being stationary with respect to the support unit 9 and consequently in the exemplary embodiment stationary with respect to the body part 2. The pivot axis 16 is at right angles to the opening and closing direction 5, 6.

The closing lever 15 is acted upon by a closing spring 17 which cooperates at the one end with the support unit 9 and at the other and with the closing lever 15.

The closing lever 15 has a slot-shaped guide track 18 for the carrier 8. When the movable furniture part is closed, the carrier 8 runs along a start 19 of the guide track 18 into said guide track and is increasingly distanced from the start 19 of the guide track 18 until achieving the closed position of the movable furniture part 4. Over the region of the movement of the movable furniture part 4 over which the carrier 8 is situated in the guide track 18, each position of the movable furniture part corresponds to a clear position of the carrier 8 in the guide track 18 and a clear pivot position of the closing lever 15 about the pivot axis 16.

As soon as the carrier 8 has moved into the guide track 18 by a small distance (said distance corresponding to less than a fifth of the entire distance between the start of the guide track and the closed position of the carrier 8), the carrier 8 advantageously comprises a relatively small amount of play in relation to the guide track 18. This is preferably smaller than 25% of the diameter of the carrier 8, in a particularly preferred manner smaller than 10% of the diameter of the carrier 8.

In the closed position of the furniture part 4, the carrier 8 is situated in a closing position in the guide track 18. The closing lever 15 is situated then in a hold-closed position with reference to its pivoting about the pivot axis 16. When the movable furniture part 4 is opened, proceeding from its closed position, the carrier 8 is moved in the guide track 18 in the direction of the start 19 of the guide track 18, pivoting the closing lever 15 about the pivot axis 16. The closing spring 17, in this connection, is increasingly tensioned until toward the end of the pivoting of the closing lever 15 a dead point of the closing spring 17 is crossed. The closing lever 15 is pivoted a little further when the furniture is opened further, the closing spring 17 being relieved a little again (preferably by less than a fifth of the preceding increase in tension) and thereupon the carrier 8 uncouples from the closing lever 15 by coming out of the guide track 18 at the start 19 thereof. The closing lever 15 is situated then in its standby position in which it is held by the closing spring 17 (it being blocked against further pivoting by a corresponding stop).

When the movable furniture part 4 is closed, proceeding from an open position, the carrier 8 runs up to the closing lever 15 which is situated in the standby position, the carrier 8 running into the guide track 18 at the start 19 thereof. When the movable furniture part 4 is closed further, the closing lever 15 is initially pivoted by the carrier 8 up to into a dead point position in which the closing spring 17 is situated at its dead point. As soon as the dead point has been exceeded, the closing lever 15 is acted upon by the closing spring 17 in the direction of its hold-closed position about the pivot axis 16. The closing lever 15 then exerts a closing force FZ onto the carrier 8. In this connection, the starting point is a speed of closing of the movable furniture part 4 of close to zero. In other words, each point of the closing path to be observed is approached and the movable furniture part 4 is then released. The position of the carrier 8 in the guide track 18, in which, as a result when the movable furniture part 4 is closed, the closing force exerted onto the carrier 8 by the closing lever 15 is set, is designated in this document as the start-of-operation position of the carrier 8 in the guide track 18. Irrespective of friction forces, the start-of-operation position lies only infinitesimally spaced apart from the position which the carrier assumes at the dead point position of the closing lever 15 in the guide track 18.

Figure 5:
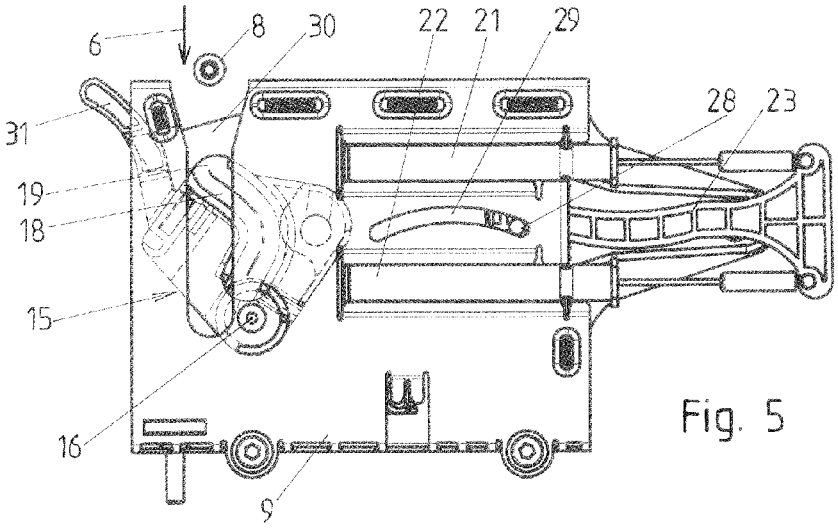
FIGS. 5 to 10 show views of the closing device (only the carrier of the carrier unit is shown) in different position when the movable furniture part is closed, in FIGS. 7*b*, 7*c* for the position according to FIG. 7*a* only the closing lever and the carrier and in FIG. 10*b* for the position according to FIG. 10*a* only the closing lever and the carrier being shown in a simplified manner.
Figure 6:
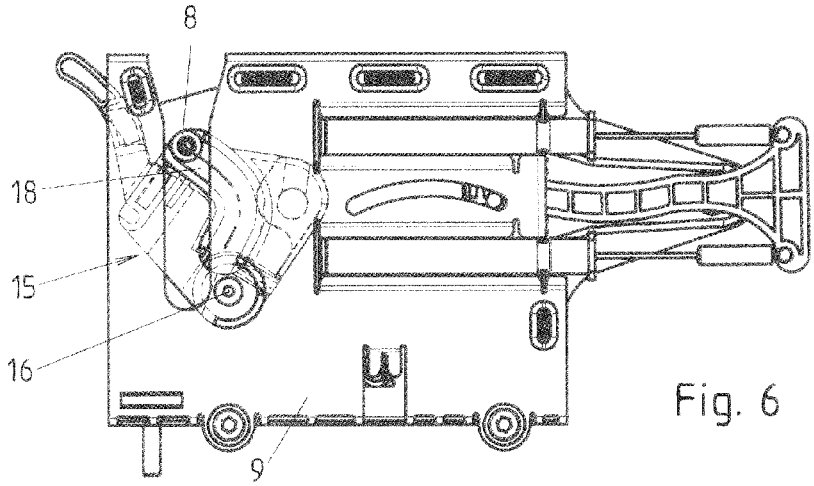
Figure 7A:
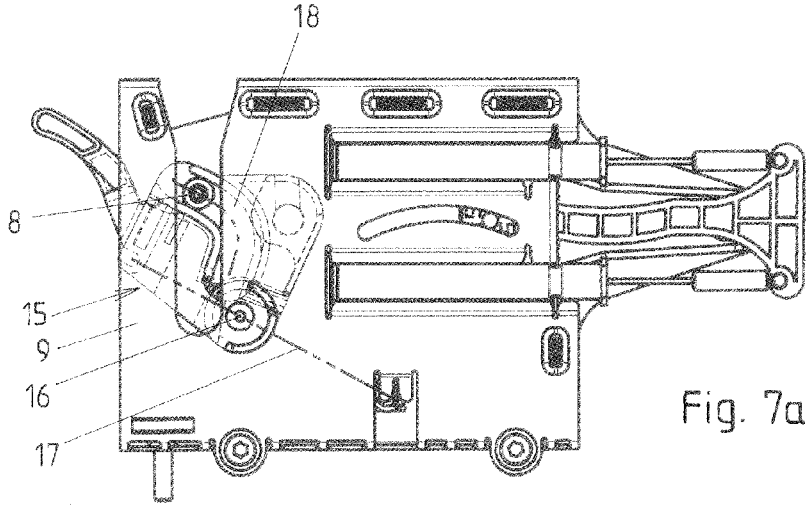

FIG. 5 shows the state when the furniture part 4 is closed before the carrier 8 has run up to the closing lever 15. FIG. 6 shows the state in which the carrier 8 is just running up to the closing lever 15 and moving into the guide track 18 at the start 19 of the same. FIG. 7*a* shows the position in which the carrier 8 is situated in its start-of-operation position. The closing lever 15 is situated consequently substantially in its dead point position. The position of the closing spring 17 not shown in FIG. 7*a* is indicated by a dot-dash line.

Figure 7B:
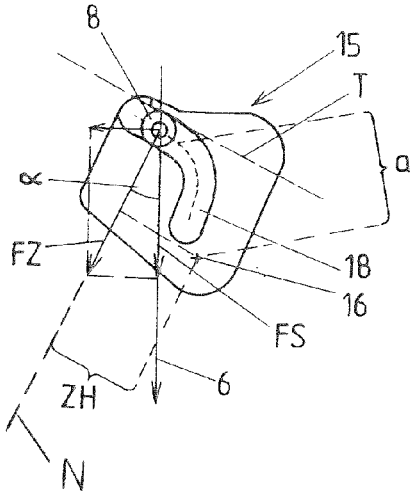

The state shown in FIG. 7*b* corresponds to that of FIG. 7*a*, only the carrier 8 and the closing lever 15 being shown. The carrier 8 is at a distance a from the pivot axis 16 of the closing lever 15. In addition, the closing force FZ is shown in FIG. 7*b*, only the correct direction, not however the correct amount being shown (this is actually only an "infinitesimal" closing force). The closing force FZ is at right angles to the tangent T (=is directed in a direction of the normal N to the tangent T) which is applied onto the wall of the guide track 18 acting on the carrier 8 at the contact point with the carrier 8. The closing force FZ can be broken down into a component acting in the closing direction 6 and a component at right angles thereto. The component acting in the closing direction 6 provides the closing force FS which acts in the closing direction 6 onto the movable furniture part 4.

The closing force FZ which is exerted onto the carrier 8 by the closing lever acts on the carrier by means of a closing lever arm which has a length ZH. This closing lever arm length ZH is the perpendicular distance between the normal N (wherein the normal N is the "effective line" of the closing force FZ) and the pivot axis 16.

FIG. 7*b* additionally shows the angle α which the closing force FZ encloses with the closing direction 6.

Figure 8:
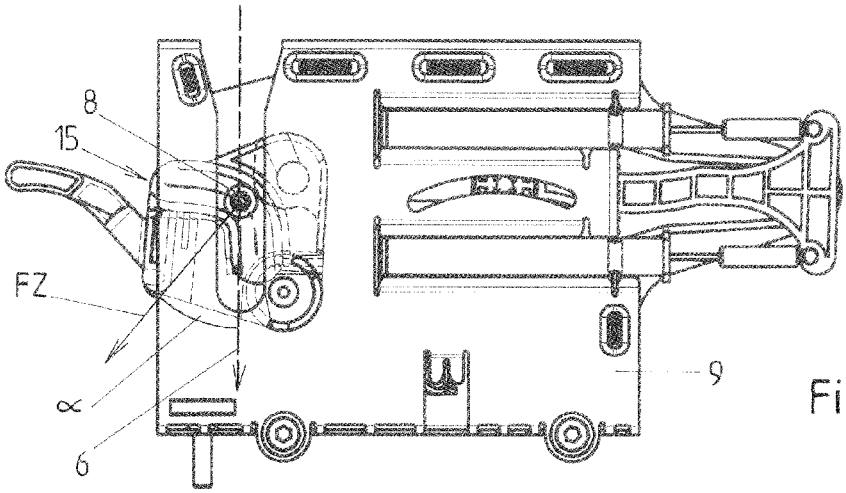
Figure 9:
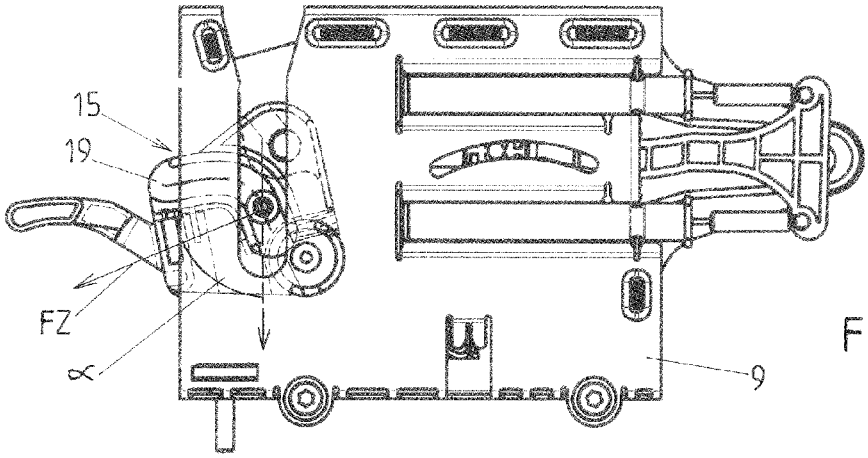

FIG. 8 and FIG. 9 show intermediate positions when the movable furniture part 4 is closed further. The closing force FZ is shown in each case (the amount not being shown correctly). It can be seen that the angle α between the closing force FZ and the closing direction 6 increases at least up to the intermediate position shown in FIG. 9.

Figure 10B:
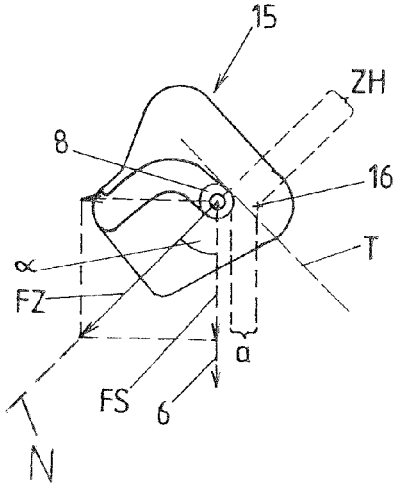
Figure 10A:
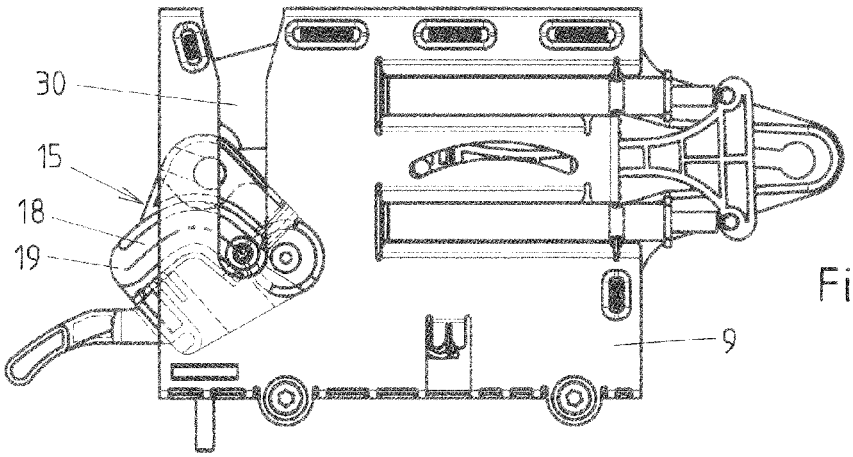

FIGS. 10*a* and 10*b* show the closed position of the movable furniture part 4 in which the closing lever 15 is situated in the hold-closed position. FIG. 10*b* once again only shows the closing lever 15 and the carrier 8, the closing force FZ being shown once again (its amount is not shown correctly).

The carrier 8 is situated in its closed position in the guide track 18. In FIGS. 10*a* and 10*b* the carrier is shown almost at the end of the guide track 18 of the closing lever 15. In practice, a sufficient distance is provided from the end of the guide track 18 in order to be able to absorb assembly and component tolerances.

In the closing position of the carrier 8, the distance a of the carrier 8 from the pivot axis 16 is substantially smaller than in the start-of-operation position of the carrier 8. In the start-of-operation position of the carrier 8, the distance a of the carrier 8 from the pivot axis 16 is at least 1.5 times as large as in the closed position of the carrier. In the exemplary embodiment shown it is more than 3 times as large.

The closing lever arm ZH, in the closed position of the carrier 8, is also substantially smaller than in the start-of-operation position of the carrier 8, in the exemplary embodiment shown approximately a third as large. In the exemplary embodiment the closing lever arm ZH reduces continually from the start-of-operation position of the carrier 8 up to the closed position of the carrier 8.

FIG. 10*b* additionally shows the components of the closing force FZ which act in the closing direction 6 and at right angles thereto. The components of the closing force FZ which act in the closing direction provide the closing force FS which acts in the closing direction 6 onto the moveable furniture part 4 in the closing position of the movable furniture part 4. As a result of said closing force, a contact face of the moveable furniture part 4 is pressed onto the body part 2. In the exemplary embodiment the body part 2 is provided with a seal 20 against which the movable furniture part 4 is pressed. A sufficiently high closing force is necessary in order to produce sufficient tightness between the movable furniture part 4 and the seal 20. The seal 20 could also be arranged on the movable furniture part 4.

So that the component of the closing force FZ which acts in the closing direction 6 is sufficiently large, in the closed position of the carrier 8 the angle α between the closing force FZ exerted onto the carrier 8 and the closing direction 6 is favorably less than 45°, in a preferred arrangement less than 40°.

The closing spring 17 in the exemplary embodiment is in the form of a helical spring which is subject to tensile stress, therefore providing a tension spring. The closing spring 17 is shown in the hold-closed position of the closing lever in FIG. 12. In the hold-closed position of the closing lever 15, the closing spring 17 comprises a residual tension compared to its non-tensioned state, i.e. its length 1 is longer than its length in the non-tensioned state. The state in which no outside forces act on the closing spring 17 is called the non-tensioned state of the closing spring 17 (inner stresses can still be present). In order to achieve the non-tensioned state, the closing spring 17 has consequently to be removed out of the closing unit. The difference between the tension which the closing spring 17 has in the dead point position of the closing lever 15 or in the start-of-operation position of the carrier 8 and in the hold-closed position of the closing lever 15 or the closed position of the carrier 8, is greater than the residual tension of the closing spring 17 in the hold-closed position of the closing lever 15 or the closed position of the carrier 8. I.e. the change in the length of the closing spring 17 between the dead point position of the closing lever 15 or the start-of-operation position of the carrier 8 and the hold-closed position of the closing lever 15 or the closed position of the carrier 8 is greater than the change in length between the hold-closed position of the closing lever 15 or the closed position of the carrier 8 and the non-tensioned state of the closing spring 17.

Figure 7C:
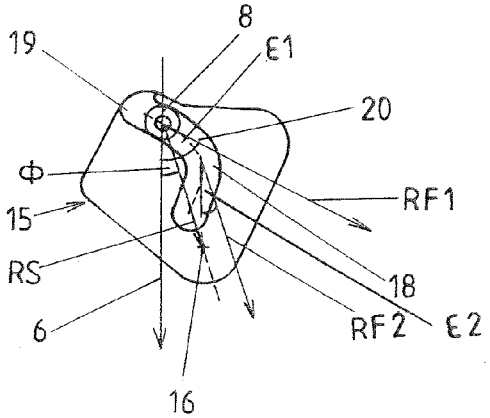

In order to influence, in a favorable manner, the development of the closing force FS which acts on the movable furniture part 4 in the closing direction, the guide track 18 has a curved development and could consequently also be called a sliding track. The curved development is to be defined by way of the position of the closing lever 15 which the latter assumes in the start-of-operation position of the carrier 8, that is substantially in the dead point position of the closing lever 15. Reference is made in this connection to FIG. 7*c* in which the closing lever 15 and the carrier 8 are shown in the position according to FIG. 7*a*. The guide track 18 has a first part portion following its start 19. By means of said first part portion the guide track extends in a direction RF1 which encloses an angle $\epsilon 1$ with the closing direction 6. The direction RS, which points from the center of the carrier 8 situated in the start-of-operation position to the pivot axis 16 of the closing lever 15, encloses with the closing direction 6 an angle $\theta$ which is smaller than the angle $\epsilon 1$. A second part portion follows the first part portion. By means of the same, the guide track extends in a direction RF2 which, with the closing direction 6, encloses a smaller angle $\epsilon 2$ than the angle $\theta$, which the direction RS encloses with the closing direction 6. In FIG. 7*c* the direction in which the guide track 18 extends proceeding from its start 19, is shown at the point at which the carrier 8 is situated in its start-of-operation position (this direction is denominated as RF1), as well as at the point of the transition between the first and the second part portion (this direction is denominated as RF2 and is parallel to the direction RS in this case). The second part section can extend up to the point of the guide track 18 at which the carrier 8 is situated in its closed position. A third part portion could also follow the second part portion, by means of which third part portion the angle E is once again greater than the angle $\theta$ (in this connection the direction of the guide track 18 can point to the other side of the closing direction 6 as in the first part portion).

Figure 11:
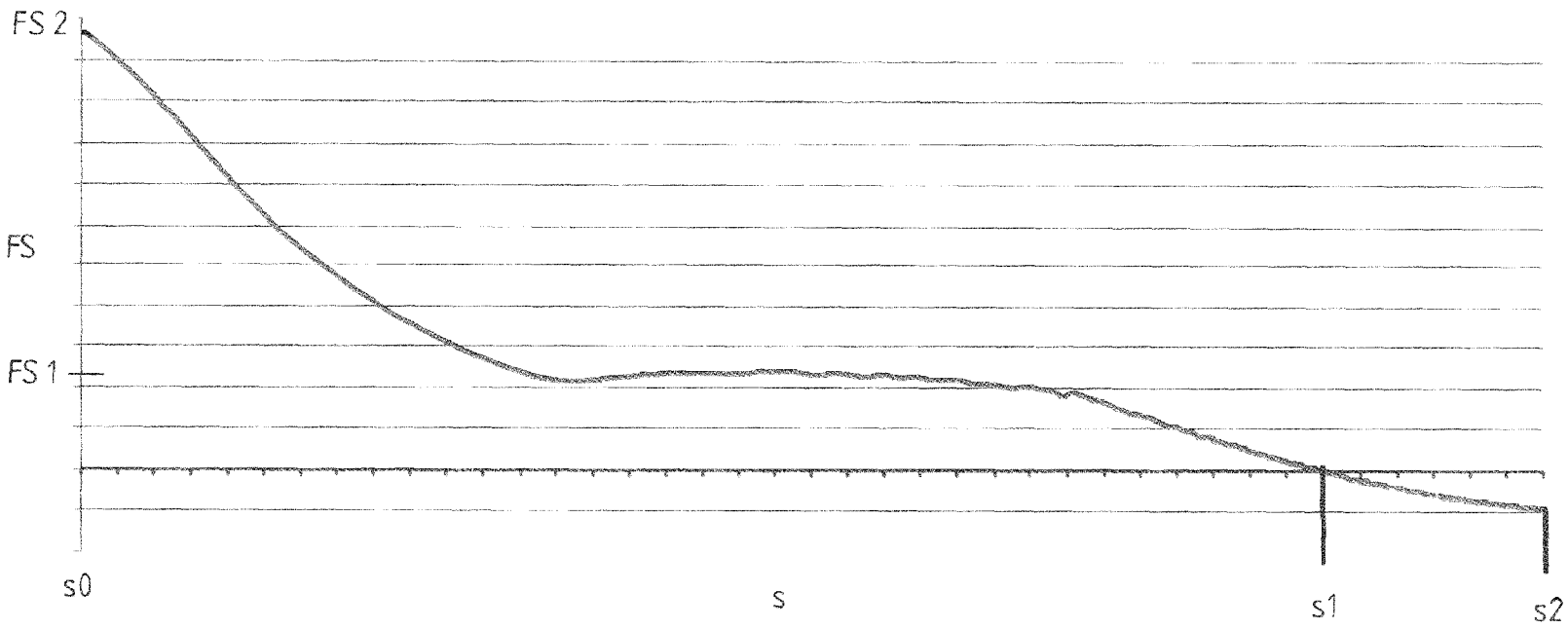
FIG. 11 shows a force/distance diagram.
Figure 12:
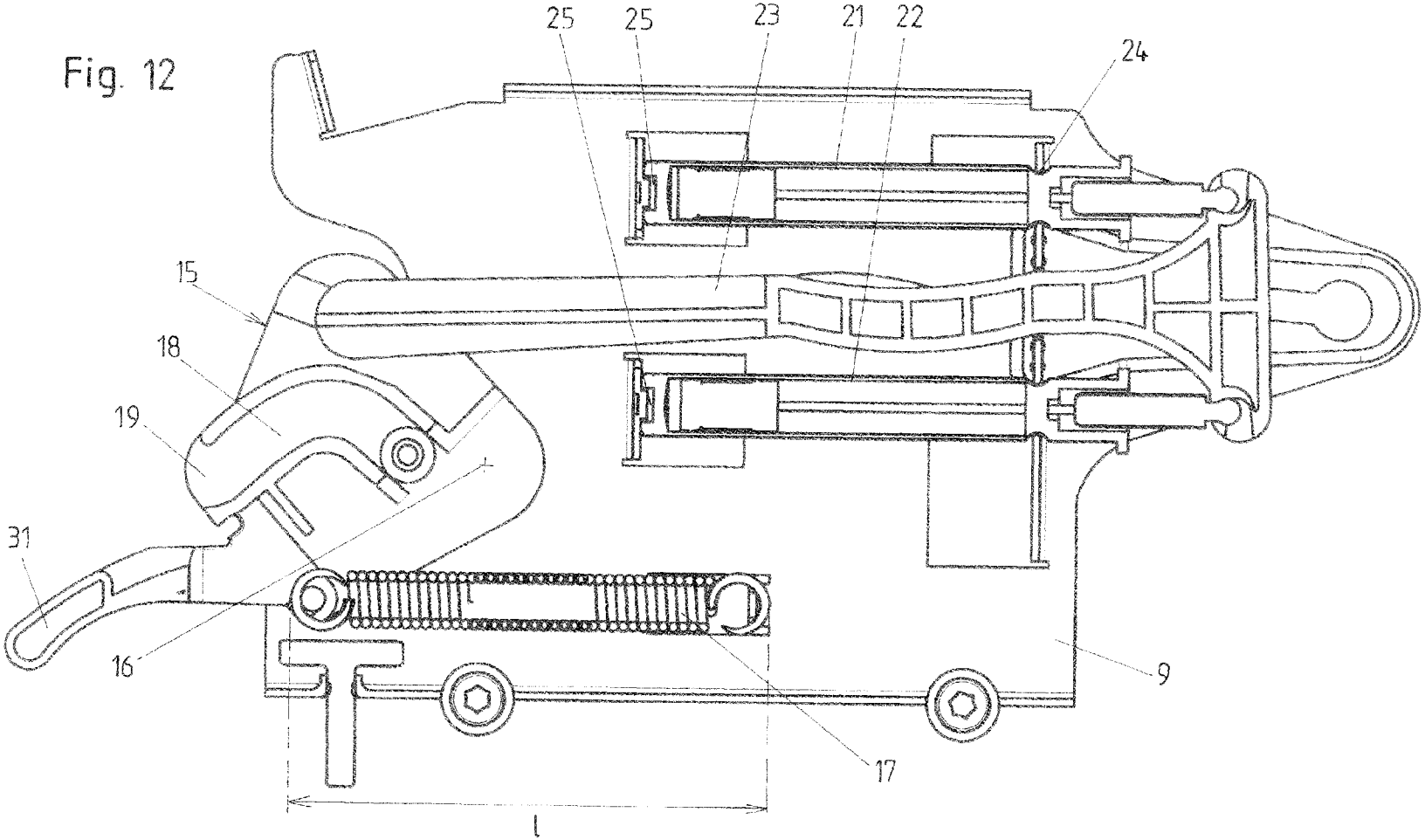
FIG. 12 shown a central section through the closing device in the closed position of the movable furniture part.

FIG. 11 shows the force/distance diagram when the movable furniture part 4 is closed. The abscissa designates the pull-out path s, that is the distance of the moveable furniture part 4 from the closed position. The ordinate designates the closing force FS which acts in the closing direction 6. When the furniture part 4, proceeding from its open position, is closed, it runs at the point S2 against the closing lever 15 and as a result the force of the closing spring 17 has to be overcome (this corresponds to a negative closing force FS) until at the point s1 the dead point position of the closing lever 15 is reached (FS=0). Where the pull-out path s is further reduced, the closing force FS increases and then remains extensively constant at a low value FS1 for a relatively large distance in order then to increase once again in the direction of the closed position. The closing force is then at a maximum value FS2 in the closed position s0 of the furniture part 4.

The development of the closing force FS is influenced as a result of the curved development of the guide track 18. If the guide track 19 were to extend in a straight line from its start 19 up to its end, the increase subsequently at s1 would be substantially flatter (so that sufficient closing force would only be achieved at a greater distance from the start-of-operation position of the carrier 8 in order to retract the furniture part 4 automatically) and would then increase quicker above the value FS1.

It can therefore be seen from the force/distance diagram that a high closing force FS2 is reached in the closed position and when the furniture part 4 is opened this drops quickly to a substantially lower value FS1. When the furniture part 4 is opened, a relatively high closing force has consequently only to be overcome just at the start of the opening process. The face under the curve for the closing force, which corresponds to the energy to be applied for opening, is relatively small. This energy to be applied is substantially for the subjective impression of the user, as to how "difficult" it is to open the furniture part 4.

Several effects are utilized in order to over-compensate for the decreasing spring force of the closing spring 17 from the start-of-operation position of the carrier 8 up to the closed position of the carrier 8. In particular, as described, the closing lever arm ZH is reduced in size. In addition, the lever arm, by means of which the closing spring 17 acts on the closing lever 15, is increased in size (this is automatically the case when the closing spring 17 in the start-of-operation position of the carrier 8 is situated substantially at its dead point). In addition, the closing spring 17, as described, is realized in a relatively long manner or with the corresponding tension differences between the start-of-operation position and the closed position of the carrier 8 and the non-tensioned state. The development of the guide track 18 is also realized in a corresponding manner, it being possible to influence the force/distance characteristic additionally in a favorable manner by the development of the guide track 18.

The pivoting of the closing lever 15 from the standby position into the hold-closed position is damped by the dampers 21, 22. Consequently, it is possible to achieve, on the one hand, a damping of a rapid running of the carrier 8 against the closing lever 15 and, on the other hand, a damped pulling closed of the movable furniture part 4 by the closing device. In the exemplary embodiment this is a question of linear dampers which are formed by hydraulically or pneumatically acting piston-cylinder units. The coupling of the dampers 21, 22 to the closing lever 15 is effected by means of a push rod 23 which is connected to the closing lever 15 so as to be pivotable. The dampers 21, 22 cooperate at the one end with the push rod 23, in the exemplary embodiment by means of their piston rods, at the other end with the support unit 9, in the exemplary embodiment shown by means of their cylinders. To support the cylinders of the dampers 21, 22 in relation to the support unit 9, the cylinders of the dampers 21, 22 comprise constrictions 24, for example as shown, into which projections of the support unit 9 engage. The bases of the cylinders of the dampers 21, 22 each have an indentation 25 into which a further projection of the support unit 9 engages. The piston rods of the dampers 21, 22 are connected to the push rod 23 so as to be pivotable in each case. The push rod has a yoke which stands in a T-shaped manner with respect to a longitudinally extending portion for connecting to the piston rods.

The push rod 23 is guided so as to be movable in relation to the support unit 9 by means of an elongated hole guide and a sliding guide. To realize the elongated hole guide, a guide journal of the push rod 23 engages in an elongated hole 27 of the support unit 9. The elongated hole 27 has a keyhole-like extension through which the enlarged head of the guide journal 26 can be inserted when mounting the closing unit 1 into the elongated hole 27. To realize the sliding guide, the push rod comprises sliding journals 28 which engage in sliding tracks 29 of the support unit 9. Oppositely situated sliding journals 28 of the push rod 23 are provided in the exemplary embodiment and two arcuately extending sliding tracks, between which the push rod 23 is guided. Just one sliding journal 28 and one arcuately extending sliding track 29 could also be provided.

The elongated hole guide lies closer to the end of the push rod which is connected to the dampers 21, 22 than the at least one sliding guide. The achievement of the correspondingly curved development of the sliding guide in conjunction with the straight-lined elongated hole guide is that when the closing lever 15 is pivoted, the end of the push rod 23 connected to the dampers 21, 22 is displaced extensively in a straight line and without a great deal of pivoting.

The dampers 21, 22 are realized in such a manner that they comprise a substantially smaller damping force or practically no damping force in the opening direction 5. Dampers with such a "free running" are known.

As, during the movement through the guide track 18, more or less large lateral forces which are aligned at right angles to the closing direction 6 act on the carrier 8, it is advantageous when the carrier 8 is guided in the closing direction 6 or in the opening direction 5 by the support unit 9. To realize such lateral guiding for the carrier 8, the support unit 9 has a slot 30 which extends in the closing direction 6 and into which the carrier 8 moves when the furniture part 4 is closed. In a favorable manner, the carrier 8 is already situated in said slot 30 of the support unit 9 when the carrier 8 runs against the closing lever 15.

The closing lever 15 should normally be situated in its standby position when the associated moveable furniture part 4 is opened. However, it is conceivable for the closing lever 15 to be pivoted over its dead point position in the open state of the furniture part 4. The closing lever 15 then snaps into an end position which lies at an end of the pivotability of the closing lever 15 opposite the standby position, that is in the vicinity of the hold-closed position. A corresponding stop is provided to define the pivoting of the closing lever 15 in said direction. In order then to put the closing device in such a case back into regular operation, the closing lever 15 comprises a self-heal arm 31 which stands out from the closing lever 15 and the carrier unit 3 comprises a self-heal journal 32.

Figure 13:
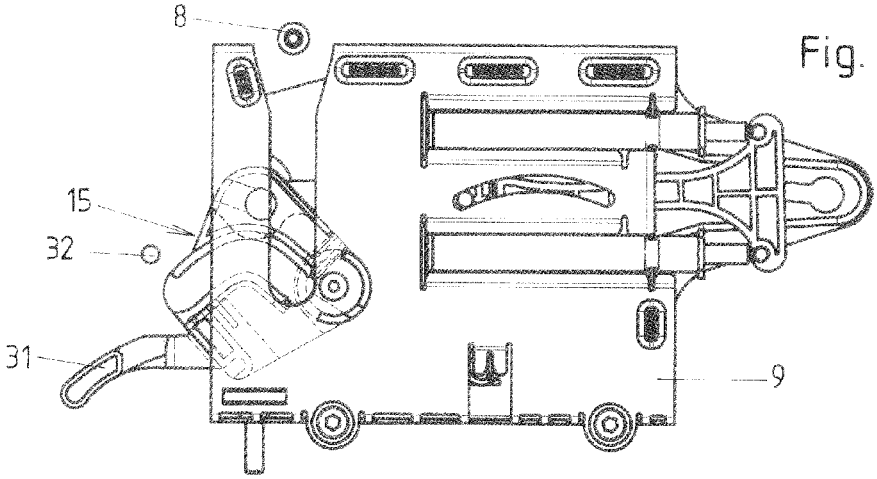
FIGS. 13 to 17 show various positions when the movable furniture part is closed against the closing lever which is already situated in its end position next to the hold-closed position and when the furniture part is subsequently opened (only the carrier and the self-heal journal are shown from the carrier unit)
Figure 14:
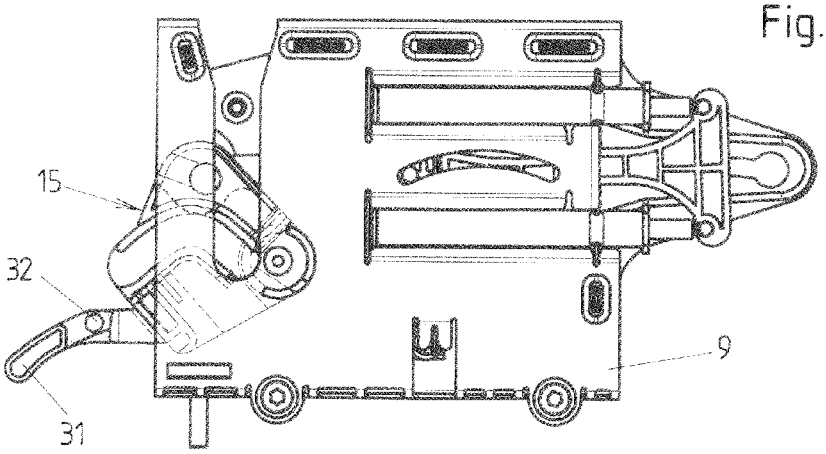
Figure 15:
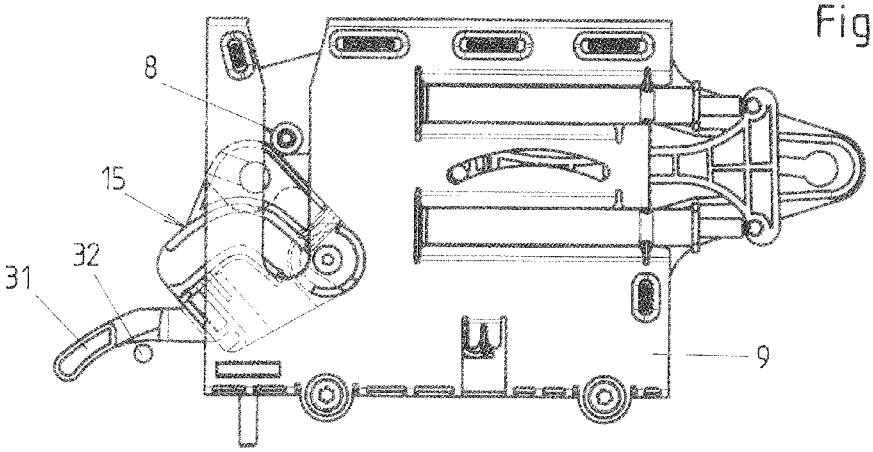
Figure 16:
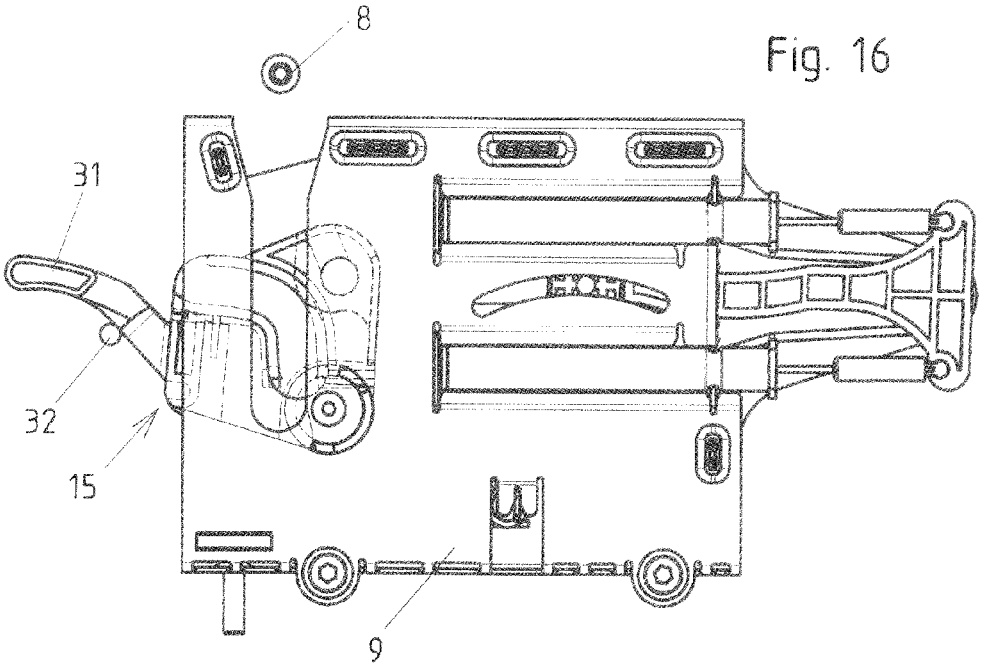
Figure 17:
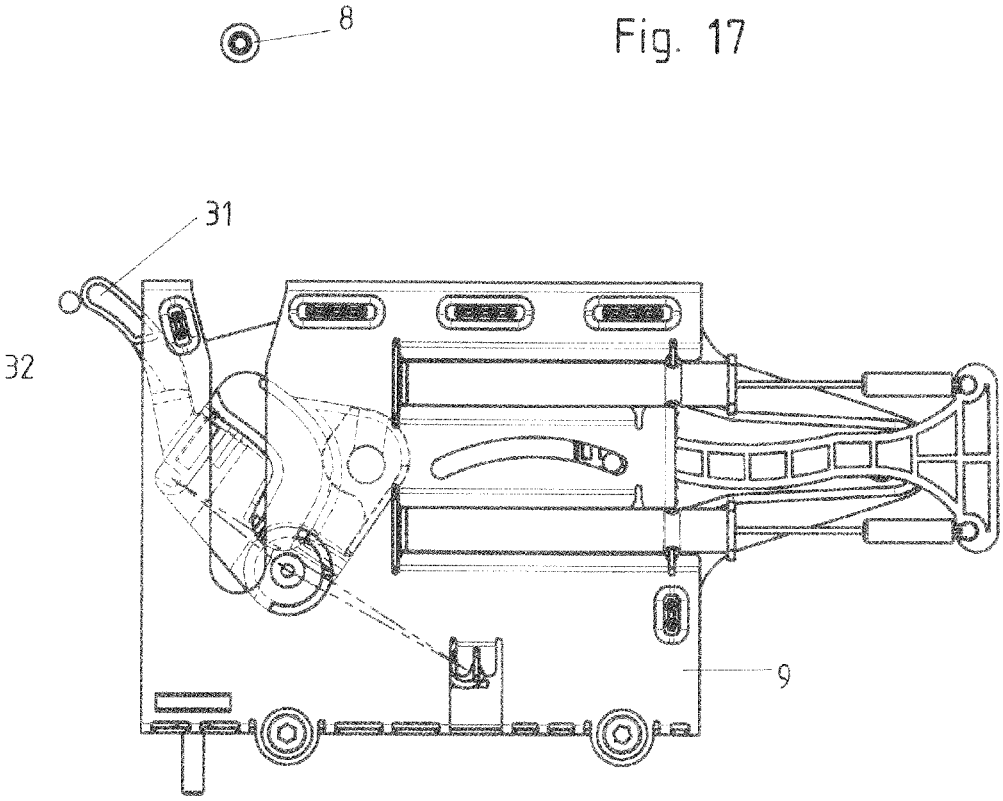
Figure 18:
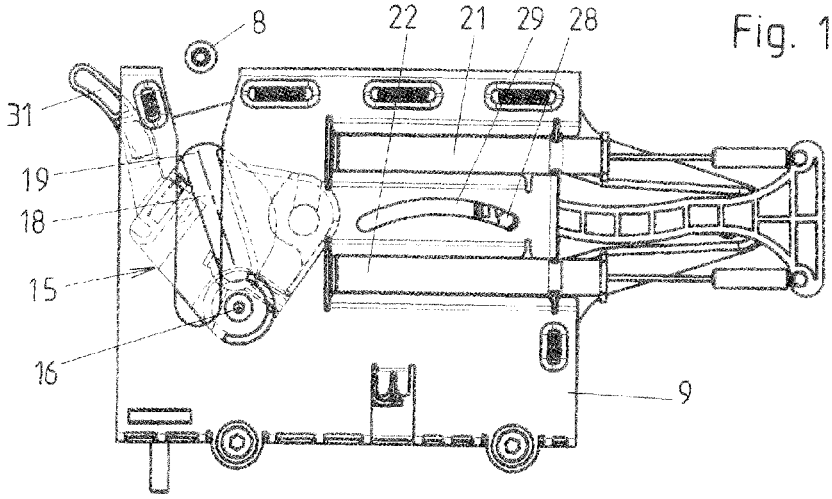
FIGS. 18 to 23 show views of a modified embodiment of the closing device in various positions when the movable furniture part is closed.
Figure 19:
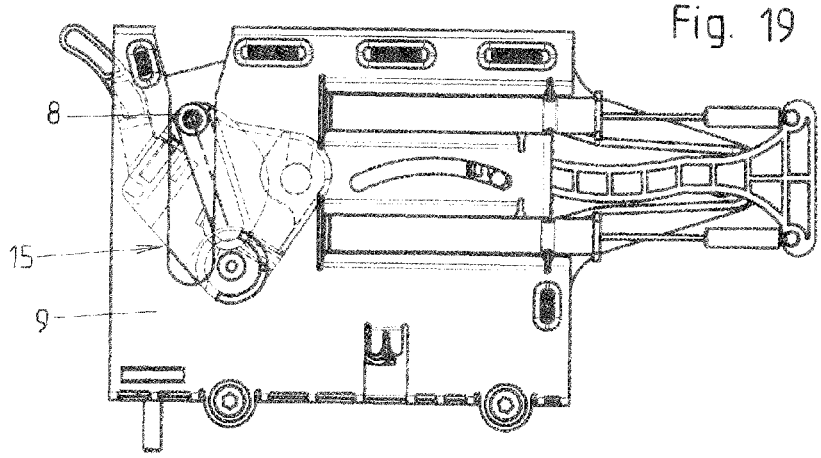

The closing of the furniture part 4 against the closing lever 15 which is situated in its end position is shown in FIGS. 13 to 15. The self-heal journal 32, in this connection, runs against the self-heal arm 31 and is guided over said arm by an inclined face of the self-heal arm 31 (utilizing the material elasticities). An inclined face can be provided on the self-heal journal 32 in addition or instead. The end of the possible closing movement of the furniture part 4 is achieved in this case when the carrier 8 runs against the closing lever 15 which is situated in its end position, cf. FIG. 15. If, subsequently, the furniture part 4 is pulled out again, the self-heal journal 32, as a result of its cooperation with the self-heal arm 31, pivots the closing lever 15 into its standby position, cf. FIGS. 16 and 17, whereupon the self-heal journal 32 uncouples from the self-heal arm 31.

Figure 20:
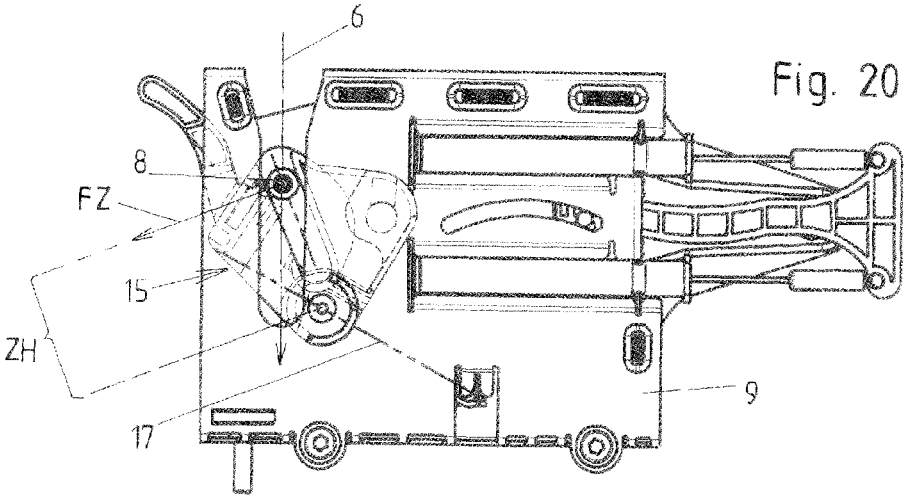
Figure 21:
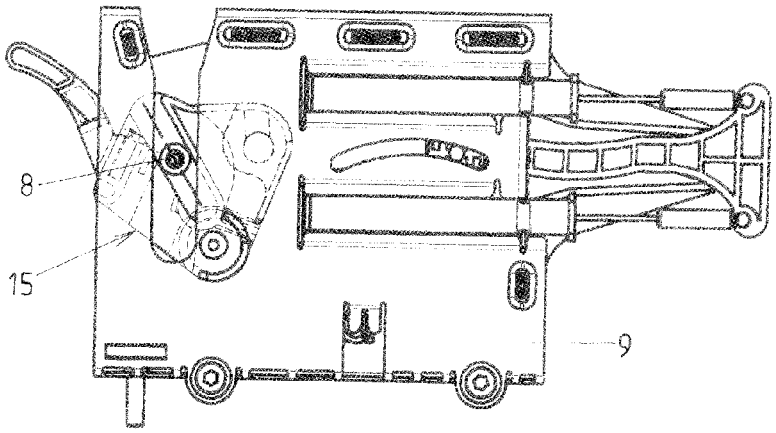
Figure 22:
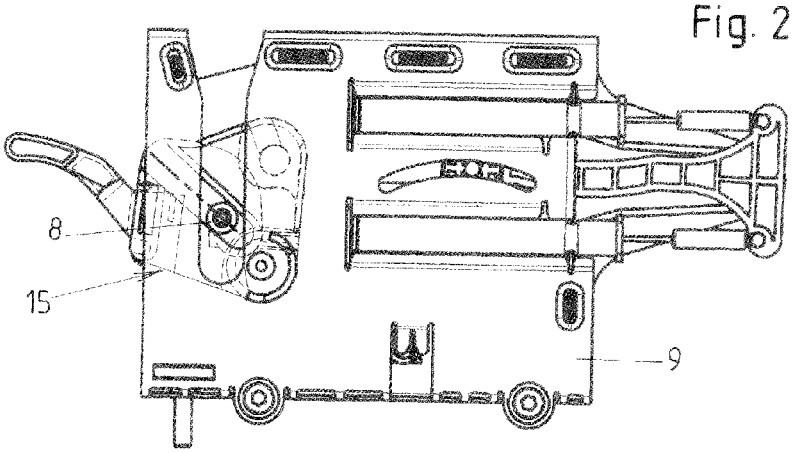
Figure 23:
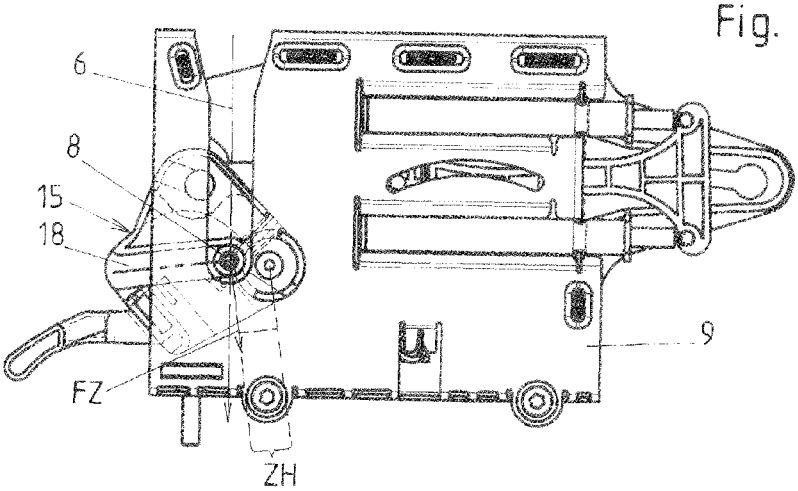

FIGS. 18 to 23 are representations that are analogous to FIGS. 5, 6, 7*a*, 8, 9 and 10*a* which show the sequence for a modified embodiment of the invention when a movable furniture part 4 is closed. The difference in relation to the embodiment described beforehand is simply that the guide track 18 of the closing lever 15 is realized in this case in a straight line. The start and the end of the guide track 18 lie at the same points as in the previously described exemplary embodiment. The force development here is certainly not quite as favorable as in the case of the previously described exemplary embodiment, however nevertheless a large closing force acting on the closed furniture part 4 in the closing direction is achieved and the force necessary to open the furniture part 4 can be kept relatively small. FIGS. 20 and 23 also show the respective closing lever arm ZH, from which can be seen that said closing lever arm is substantially longer in the start-of-operation position of the carrier 8 than in the closed position of the carrier 8, in all cases 1.5 times as long, preferably twice or multiple times as long.

Various further or other modifications of a closing device according to the invention are conceivable and possible. Thus, for example, a compression spring formed by a helical spring could also be used for the closing spring 17. If necessary, a support against lateral buckling can be provided, for example in the form of a sleeve which surrounds the helical spring. Different types of closing springs can also be used as helical springs, for example leg springs.

In order to hold the closing lever 15 in it standby position, the described traveling over a dead point of the closing spring 17 is a particularly simple possibility. However, other types of latching of the closing lever 15 in its standby position can also be provided. Thus, adjustable latching elements which are actuated by the incoming carrier 8 could be provided. The start-of-operation position of the carrier would then be situated at the point where the carrier has actuated such a latching element and the closing lever 15 has been released such that it is able to be pivoted by the closing spring 17.

Figure 2:
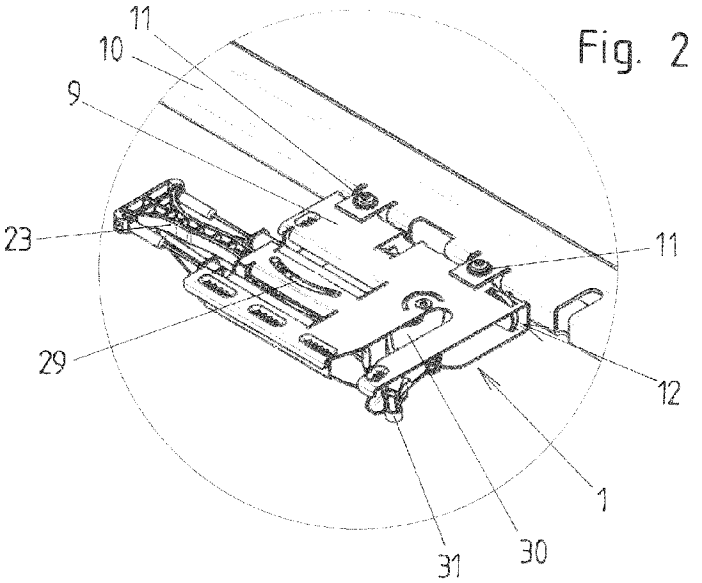
FIG. 2 shows an enlarged detail A from FIG. 1.
Figure 3:
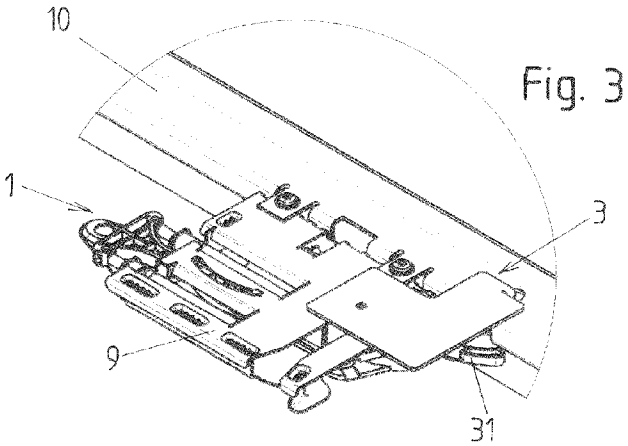
FIG. 3 shows an enlarged detail B from FIG. 1.

FIGS. 1 to 3 show the mounting of the respective closing unit 1 on the body part 2 and of the respective carrier unit 3 on the respective movable furniture part 4 and the functioning of the closing device has been described subsequently for said arrangement of the closing unit 1 and of the carrier unit 3. However, a respective closing unit 1 could also be mounted on the movable furniture part 4 and the respectively associated carrier unit 3 on the body part 2. The functioning in the case of such a kinematic reversal is totally analogous.

The Figures show the use of a closing device in conjunction with a furniture part 4 which can be pulled out and retracted in a straight line. A closing device according to the invention could also be provided for a pivotably mounted furniture part, for example a door or a flap could be provided with a closing device according to the invention. If the carrier is mounted at the end face on said pivotable furniture part, the sequences corresponding to FIGS. 5 to 10 and 13 to 23 would appear totally identical (the carrier would just be displaced slightly in relation to the drawing plane). It would also be possible to attach the carrier on a side of the furniture part pointing in the direction of the pivot axis of the furniture part. The slightly arcuate development of the carrier would then have to be taken into account in a corresponding manner (the current opening direction or closing direction would in each case be the tangent to said arcuate development).

| Key to the Reference Numbers: | |
|---|---|
| 1 | Closing unit |
| 2 | Body part |
| 3 | Carrier unit |
| 4 | Movable furniture part |
| 5 | Opening direction |
| 6 | Closing direction |
| 7 | Support plate |
| 8 | Carrier |
| 9 | Support unit |
| 10 | Mounting rail |
| 11 | Fastening screw |
| 12 | Adjusting screw |
| 13 | Head |

-continued

| Key to the Reference Numbers: | |
|---|---|
| 14 | Shaft |
| 15 | Closing lever |
| 16 | Pivot axis |
| 17 | Closing spring |
| 18 | Guide track |
| 19 | Start |
| 20 | Seal |
| 21 | Damper |
| 22 | Damper |
| 23 | Push rod |
| 24 | Constriction |
| 25 | Indentation |
| 26 | Guide journal |
| 27 | Elongated hole |
| 28 | Sliding journal |
| 29 | Sliding track |
| 30 | Slot |
| 31 | Self-heal arm |
| 32 | Self-heal journal |

The invention claimed is:

1. A closing device for a movably mounted furniture part which, proceeding from a closed position in which a contact face of the movable furniture part abuts against a body part, is openable to an open position, and is closable from the open position into the closed position, the closing device comprising a carrier which is connectable to the movable furniture part or to the body part, a support unit that is connectable to the body part, when the carrier is connected to the movable furniture part, or to the movable furniture part when the carrier is connected to the body part, a closing lever pivotably mounted on the support unit for movement in an opening direction and a closing direction about a pivot axis that is stationary in relation to the support unit, the closing lever including a guide track for the carrier, the guide track having a path beginning at a start portion that is adapted to receive the carrier, a closing spring having a first end connected to the support unit and a second end connected to the closing lever, wherein the closing lever is pivotable about the pivot axis from a hold-closed position, which the closing lever is adapted to assume in the closed position of the movable furniture part, to a standby position, in which the carrier uncouples from the start portion of the path of the guide track, and the closing lever is pivotable, by the carrier running into the guide track about the pivot axis, from the standby position in a direction of the hold-closed position, so that when a dead point of the closing spring is overcome the closing spring starts to exert a force onto the closing lever which acts to pivot the closing lever towards the hold-closed position whereby the closing lever starts to exert a closing force (FZ) onto the carrier, wherein the carrier assumes a start-of-operation position in the guide track at a first point on the path of the guide track that causes the closing lever to rotate past the dead point of the closing spring so that the closing lever starts to exert the closing force (FZ) onto the carrier and the carrier assumes a closing position at a second point on the path of the guide track when the closing lever assumes the hold-closed position, wherein a distance (a) of the first point on the path to the pivot axis is at least 1.5 times as great as a distance to the second point on the path to the pivot axis, wherein the second point on the path is distanced further from the start portion of the guide track than the first point on the path, and wherein the path of the guide track has an at least partially curved section lying between the start position and the path end.

2. The closing device as claimed in claim 1, wherein a closing lever arm length (ZH) is a perpendicular distance between a normal to the guide track and the pivot axis of the closing lever, and wherein the closing lever arm length (ZH) is at least 1.5 times as long at the start-of-operation position of the guide track than at the closing position of the guide track.

3. The closing device as claimed in claim 2, wherein the closing lever arm length (ZH) reduces continually from the start-of-operation position up to the closing position or reduces continually up to a minimum and after running through said minimum increases again by a maximum of 30% in relation to a value present at the minimum.

4. The closing device as claimed in claim 1, wherein at the closing position, an angle ($\alpha$) between a direction of the normal to the guide track and the closing direction is less than 45°.

5. The closing device as claimed in claim 4, wherein the angle ($\alpha$) formed between the normal to the guide path at a location of the carrier and the closing direction increases at least over part of the pivoting of the closing lever from the start-of-operation position to the closing position.

6. The closing device as claimed in claim 1, wherein the closing spring is arranged such that the tension of the closing spring when the carrier is in the closing position is greater than a difference between the tension of the closing spring in the start-of-operation position of the carrier and the tension of the closing spring in the closing position of the carrier.

7. The closing device as claimed in claim 1, wherein the closing spring is a tension spring.

8. The closing device as claimed in claim 1, further comprising at least one damper that damps the pivoting of the closing lever from the standby position into the hold-closed position.

9. The closing device as claimed in claim 8, wherein one of the at least one dampers is formed by a piston-cylinder unit which is connected at a first end to a push rod which is pivotably connected to the closing lever at a second end to the support unit.

10. The closing device as claimed in claim 1, wherein the closing lever comprises a self-heal arm which interacts with a self-heal journal, wherein, in the event of the movable furniture part closing against the closing lever, which is situated in an end position which lies at an end of the pivotability of the closing lever opposite the standby position, the self-heal journal is guided by an inclined face over the self-heal arm and latches in behind said self-heal arm and during a subsequent opening of the movable furniture part pivots the closing lever into the standby position in which the self-heal journal uncouples from the self-heal arm.

11. An item of furniture having a movable furniture part which, proceeding from a closed position in which a contact face of the movable furniture part abuts against a body part, is openable in an opening direction into an open position and is closable from the open position into the closed position in a closing direction which is opposite the opening direction, and a closing device as claimed in claim 1 is connected to the movable furniture part.

12. The item of furniture as claimed in claim 11, wherein the movable furniture part with the closing device is sealed by a seal in relation to the body part in the closed position thereof.

13. The closing device as claimed in claim 1, wherein the curved path of the guide track runs over a first part portion which adjoins the start of the guide track and over a second part portion which adjoins the first part portion, wherein with reference to a position of the closing lever in the start-of-operation position of the carrier, a first direction (RF1) in which the path runs in the first part portion encloses a first angle ($\epsilon 1$) with the closing direction, a second direction (RF2) in which the path runs in the second part portion encloses a second angle ($\epsilon 2$) with the closing direction, and a reference direction (RS) which points from a center of the carrier situated in the start-of-operation position to the pivot axis encloses a third angle ($\theta$) with the closing direction, and wherein the first angle ($\epsilon 1$) is greater than the third angle ($\theta$) and the second angle ($\epsilon 2$) is smaller than the third angle ($\theta$).

14. A closing device for a movably mounted furniture part which, proceeding from a closed position in which a contact face of the movable furniture part abuts against a body part, is openable to an open position, and is closable from the open position into the closed position, the closing device comprising a carrier which is connectable to the movable furniture part or to the body part, a support unit that is connectable to the body part, when the carrier is connected to the movable furniture part, or to the movable furniture part when the carrier is connected to the body part, a closing lever pivotably mounted on the support unit for movement in an opening direction and a closing direction about a pivot axis that is stationary in relation to the support unit, the closing lever including a guide track for the carrier having a path beginning at a start portion that is adapted to receive the carrier, a closing spring having a first end connected to the support unit and a second end connected to the closing lever, wherein the closing lever is pivotable about the pivot axis from a hold-closed position, which the closing lever is adapted to assume in the closed position of the movable furniture part and in which the carrier is situated in the closing position in the guide track, to a standby position, in which the carrier uncouples from the start portion of the guide track, and the closing lever is pivotable, by the carrier running into the guide track about the pivot axis, from the standby position in the direction of the hold-closed position, so that when a dead point of the closing spring is overcome the closing spring starts to exert a force onto the closing lever which acts to pivot the closing lever towards the hold-closed position whereby the closing lever starts to exert a closing force (FZ) onto the carrier, wherein the carrier assumes a start-of-operation position in the guide track when the closing lever starts to exert the closing force (FZ) on the carrier and the carrier assumes the closing position in the guide track when the closing lever assumes the hold-closed position, wherein with reference to a position of the closing lever in the start-of-operation position of the carrier, a first direction (RF1) in which the path runs in the first part portion encloses a first angle ($\epsilon 1$) with the closing direction, a second direction (RF2) in which the path runs in the second part portion encloses a second angle ($\epsilon 2$) with the closing direction, and a reference direction (RS) which points from a center of the carrier situated in the start-of-operation position to the pivot axis encloses a third angle ($\theta$) with the closing direction, and wherein the first angle ($\epsilon 1$) is greater than the third angle ($\theta$) and the second angle ($\epsilon 2$) is smaller than the third angle ($\theta$).

15. A piece of furniture comprising a body part, a moveable furniture part, and the closing device as claimed in claim 14 connected between the body part and the moveable furniture part.

16. A piece of furniture comprising a body part, a moveable furniture part, and the closing device as claimed in claim 1 connected between the body part and the moveable furniture part.

17. An item of furniture having a movable furniture part which, proceeding from a closed position in which a contact face of the movable furniture part abuts against a body part, is openable in an opening direction into an open position and is closable from the open position into the closed position in a closing direction which is opposite the opening direction, and a closing device as claimed in claim 1 with the carrier connected to the movable furniture part and the support unit connected to the body part, the start portion of the path of the guide track facing in the opening direction of the movable furniture part, and the carrier is movable by the movable furniture part to enter the start position of the path upon movement of the movable furniture part toward the closed position, and contacts at the first point on the path of the guide track to cause the closing lever to rotate past the dead point of the closing spring so that the closing lever starts to exert the closing force (FZ) onto the carrier such that the carrier assumes the closing position at the second point on the path of the guide track when the closing lever assumes the hold-closed position.

* * * * *